US005893595A

United States Patent [19]

Corbett

[11] Patent Number: 5,893,595

[45] Date of Patent: Apr. 13, 1999

[54] LIFTING DEVICE FOR SLAB, PANEL OR SHEET MATERIALS

[75] Inventor: James Edmund Corbett, Baulkham Hills, Australia

[73] Assignee: Herdgraph Pty Ltd, North Rocks, Australia

[21] Appl. No.: 08/913,632

[22] PCT Filed: Mar. 21, 1996

[86] PCT No.: PCT/AU96/00152

§ 371 Date: Sep. 19, 1997

§ 102(e) Date: Sep. 19, 1997

[87] PCT Pub. No.: WO96/29273

PCT Pub. Date: Sep. 26, 1996

[30] Foreign Application Priority Data

Mar. 21, 1995 [AU] Australia ..... PN1862

[51] Int. Cl.[6] ..... B66C 1/48

[52] U.S. Cl. ..... 294/102.1; 294/103.1; 294/119.1

[58] Field of Search ..... 294/16, 62, 63.1, 294/67.33, 81.6, 81.62, 101, 102.1, 103.1, 104, 114, 116, 119.1, 901

[56] References Cited

U.S. PATENT DOCUMENTS

| | | | |
|---|---|---|---|
| 2,387,408 | 10/1945 | Pertuit | 294/102.1 |
| 2,550,424 | 4/1951 | Penn | 294/103.1 |
| 2,559,223 | 7/1951 | Murray | 294/86.4 |
| 2,569,966 | 10/1951 | Arrigoni | 294/102.1 X |
| 3,008,749 | 11/1961 | Gowan | 294/86.4 |
| 3,101,956 | 8/1963 | Muller | 294/103.1 X |
| 3,197,250 | 7/1965 | Trotta et al. | 294/102.1 |
| 3,244,291 | 4/1966 | Dexter | 294/119.1 X |
| 3,292,964 | 12/1966 | Albert | 294/102.1 |
| 3,524,670 | 8/1970 | Ilich | 294/16 X |
| 3,851,358 | 12/1974 | Janosko | 294/103.1 X |
| 3,926,468 | 12/1975 | Kondo | 294/102.1 |

FOREIGN PATENT DOCUMENTS

| | | | |
|---|---|---|---|
| 1435976 | 3/1966 | France | 294/103.1 |
| 256115 | 4/1988 | German Dem. Rep. . | |
| 1207983 | 1/1986 | U.S.S.R. | 294/101 |

*Primary Examiner*—Johnny D. Cherry
*Attorney, Agent, or Firm*—Foley & Lardner

[57] ABSTRACT

A lifting device suited for use in lifting and handling heavy slabs, sheets of material, or panels generally includes a frame comprising side-plates, the upper ends of which are rigidly secured together by cross-members. The lower portion of one side-plate is angled downwardly and away from the other side-plate. A carriage is arranged between the lower portion of the one side-plate and a movable jaw for vertical movement with respect to the frame. The movable jaw is mounted for horizontal sliding movement on the cross-members between the side-plates. The carriage is suspended from a tension-member, which is guided for vertical movement by the cross-members and has its upper end secured to (or formed as) a lifting lug. When the lifting device is placed over, for example, a slab to be lifted, the carriage is raised by lifting the tension-member, and the slab is clamped sufficiently tightly to be lifted.

11 Claims, 7 Drawing Sheets

LIFTING DEVICE FOR SLAB, PANEL OR SHEET MATERIALS

TECHNICAL FIELD

Figure 1:
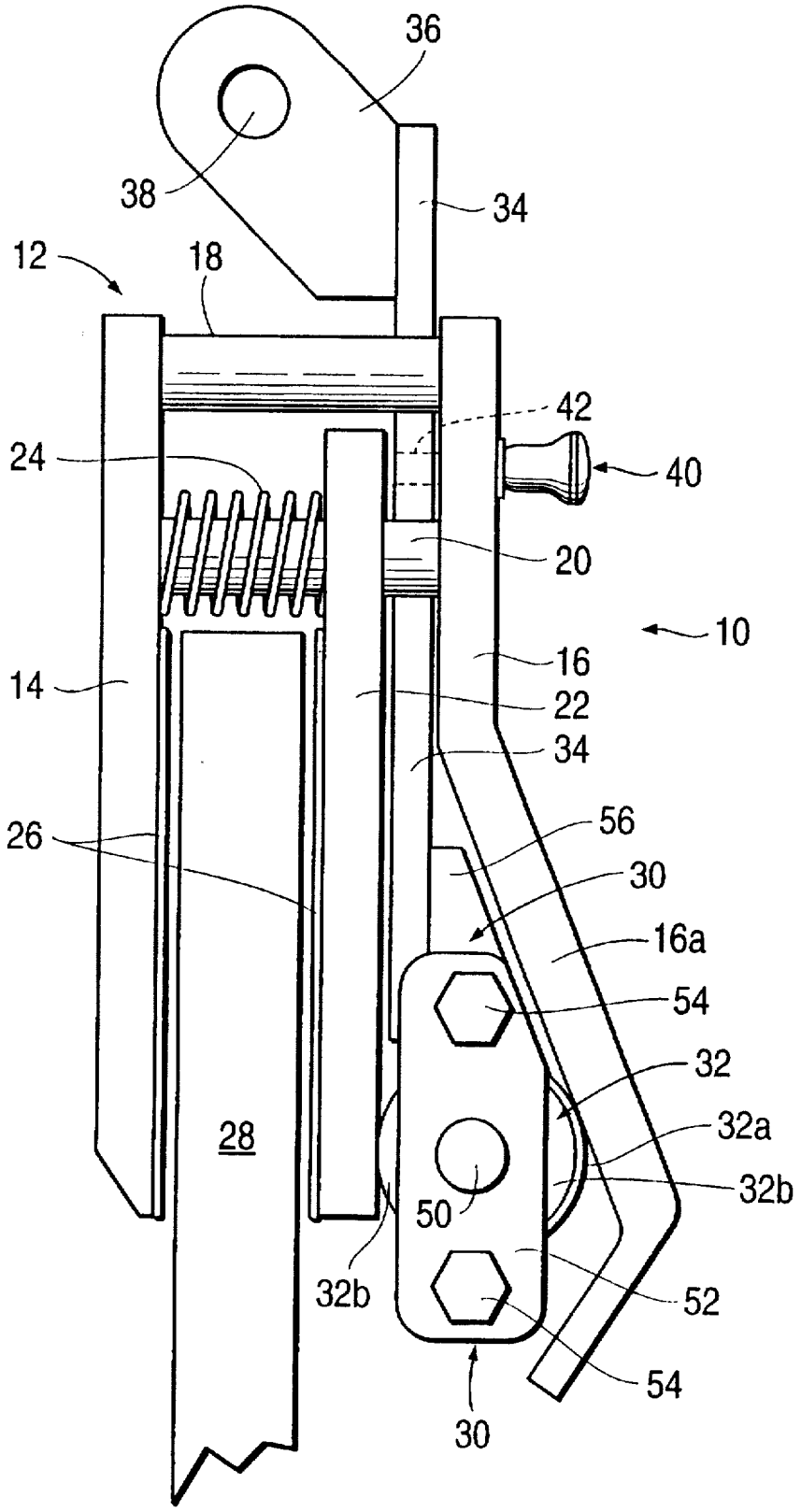

This invention relates to devices suited to the lifting and handling of slab, panel or sheet materials by gripping their faces at one edge. It is particularly concerned with devices suitable for lifting and handling heavy slabs or sheets of masonry, concrete, marble, granite, metal and the like materials. However, the use of the device is not limited to the such applications as it can be usefully employed horizontally as a clamp or haulage attachment.

As heavy slab, panel or sheet materials are commonly stored standing up and are gripped by lifting devices at their upper edges, it will be convenient to describe the lifting or handling device of this invention as if it were oriented to grip the faces of a standing slab across its upper edge. Thus, although parts of the device will be referred to as being 'vertical' or 'horizontal', it will be appreciated that this terminology is adopted for clarity and convenience only as the device can be used at any angle from horizontal to vertical.

BACKGROUND TO THE INVENTION

Heavy slabs and sheets of material are commonly stacked standing on an edge leaning against an A-frame. To lift the outer slab from the stack, it first must be pivoted away from the adjacent slab until it can be gripped by a lifting device. The angle through which the outer slab must be pivoted depends upon the clearance needed to allow the lifting device to engage the slab. Since the lifting devices almost universally employed are of the scissors (or lazy tongs) variety, the outer slab must be pivoted through a substantial angle. This can be very dangerous for the operator as the heavy outer slab is likely to over-balance and fall. Also, valuable slabs of materials such as marble and granite are likely to break when they fall resulting in considerable financial loss.

Furthermore, it is often necessary to position a slab or panel which has been lifted by a device against a wall or vertical frame to which it is to be secured. Again, the use of scissors-type lifting devices often means that the slab or panel must be propped well off-vertical in a potentially dangerous position while the device is disengaged. Only after the device has been removed is it possible to then tilt the slab or panel to the vertical position in which it is to be fixed. The vertical clearance above the slab or panel for the attachment and/or removal of the scissors-type device also presents substantial problems in practice.

OBJECTIVES OF THE INVENTION

It is the general object of this invention to provide an improved lifting device suitable for use in lifting heavy slabs or sheet material from a standing stack. The invention also seeks to provide a device which will have application as a clamp or a haulage attachment for use with sheet and other workpieces.

OUTLINE OF INVENTION

The present invention is based upon the realization that a simple and compact lifting device for lifting and handling heavy slab and sheet materials would result if the lifting force were to be applied through a tension member to a carriage that travels in a tapered housing or frame to drive a moving jaw or plate toward one side of the frame—which then forms a fixed jaw. Conveniently, the housing or frame has two substantially vertical sides which have their upper portions rigidly joined by a substantially horizontal cross-member on which the moving jaw (which is arranged substantially vertical) is slidably mounted. The lower portion of the side opposed to that which forms the fixed jaw conveniently diverges downwardly and away from the fixed jaw so that the carriage can be accommodated between it and the moving jaw. As the side which forms the fixed jaw need be no thicker than its strength requires, it permits the device to be attached to and detached from a slab with only enough clearance to enter the fixed jaw between that slab and an adjacent slab or wall frame. Such a device also requires little headroom for its attachment and detachment from the slab or panel.

The carriage is preferably provided with low-friction bearings which contact the movable jaw and the frame side which is tapered or sloped. While these can be lubricated sliding bearing pads or unlubricated pads (eg. Teflon), it is preferable that two sets of rollers or wheels be used (preferably mounted on the same shaft) such that one set is arranged to contact the sloping frame side (but not the movable jaw) and that another set is arranged to contact the movable jaw but not the sloping side of the frame. In this way, the scuffing of the rollers or wheels against both the movable jaw and the frame side is avoided.

In another arrangement, both sides of the frame can diverge downwardly and outwardly so that two opposed movable jaws can be slidingly mounted on the cross-member to grip the slab or panel between them and so that one carriage can be arranged between each moving jaw and the adjacent side of the frame. In such an arrangement, each carriage will by supported by a tension member, both of which will be used to suspend or pull the lifting device.

The movable jaw or jaws may be biased to the open position by the use of a spring or the like. In addition to or instead of the bias, locking means may be provided by which the movable jaw can be locked or retained in any desired position while the device is being lifted for placement on a slab. The tension member by which each carriage is suspended may conveniently take the form of a strip or bar of some rigidity and by which the carriage can be located in the direction orthogonal to the movement of the movable jaws, the tension member or members being guided by or in the cross-member for this purpose. Alternatively, the tension member may be a flexible cable and, in that case, may be passed through a slot in the upper portion of the adjacent moving jaw so that it may be used to withdraw, or to bias, the associated moving jaw to its open position.

DESCRIPTION OF EXAMPLES

Figure 2:
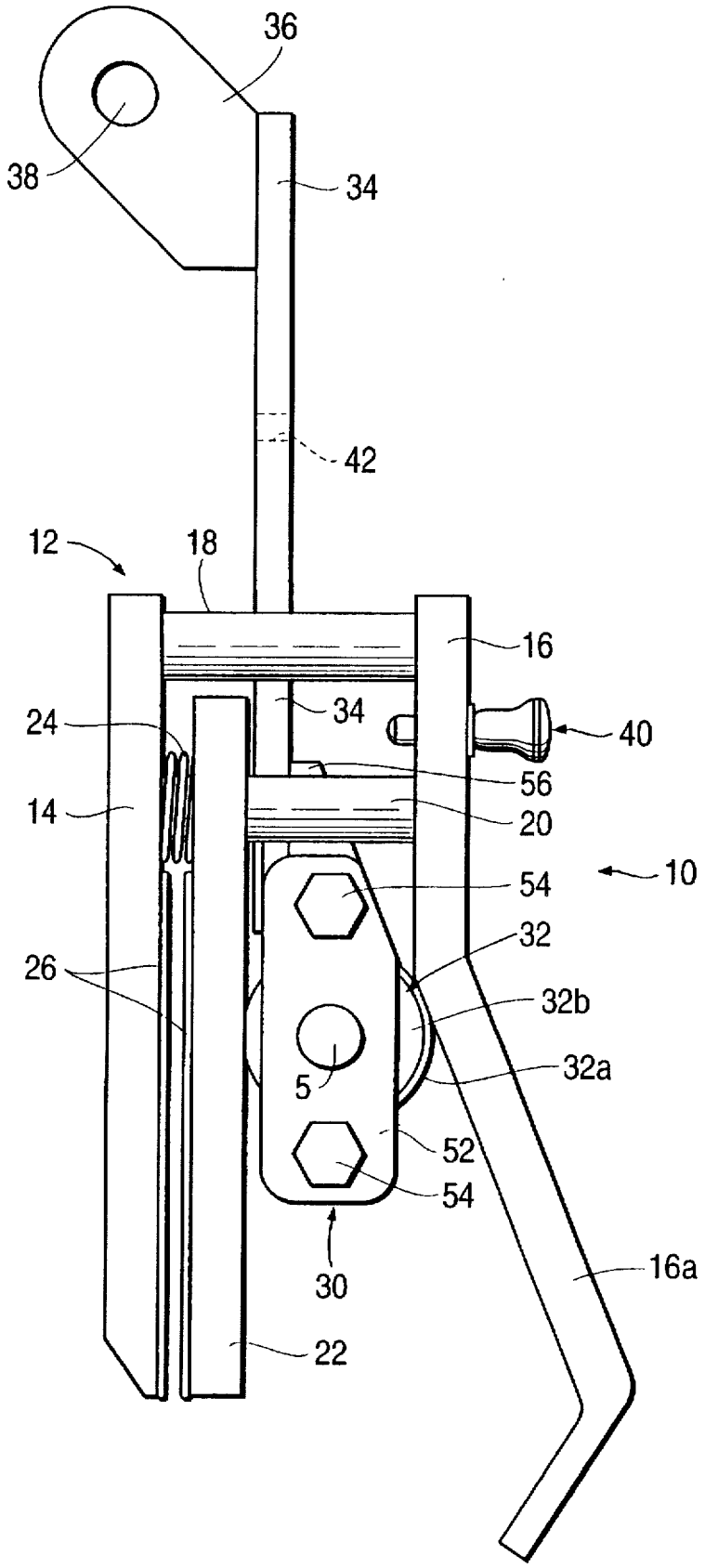
Figure 3:
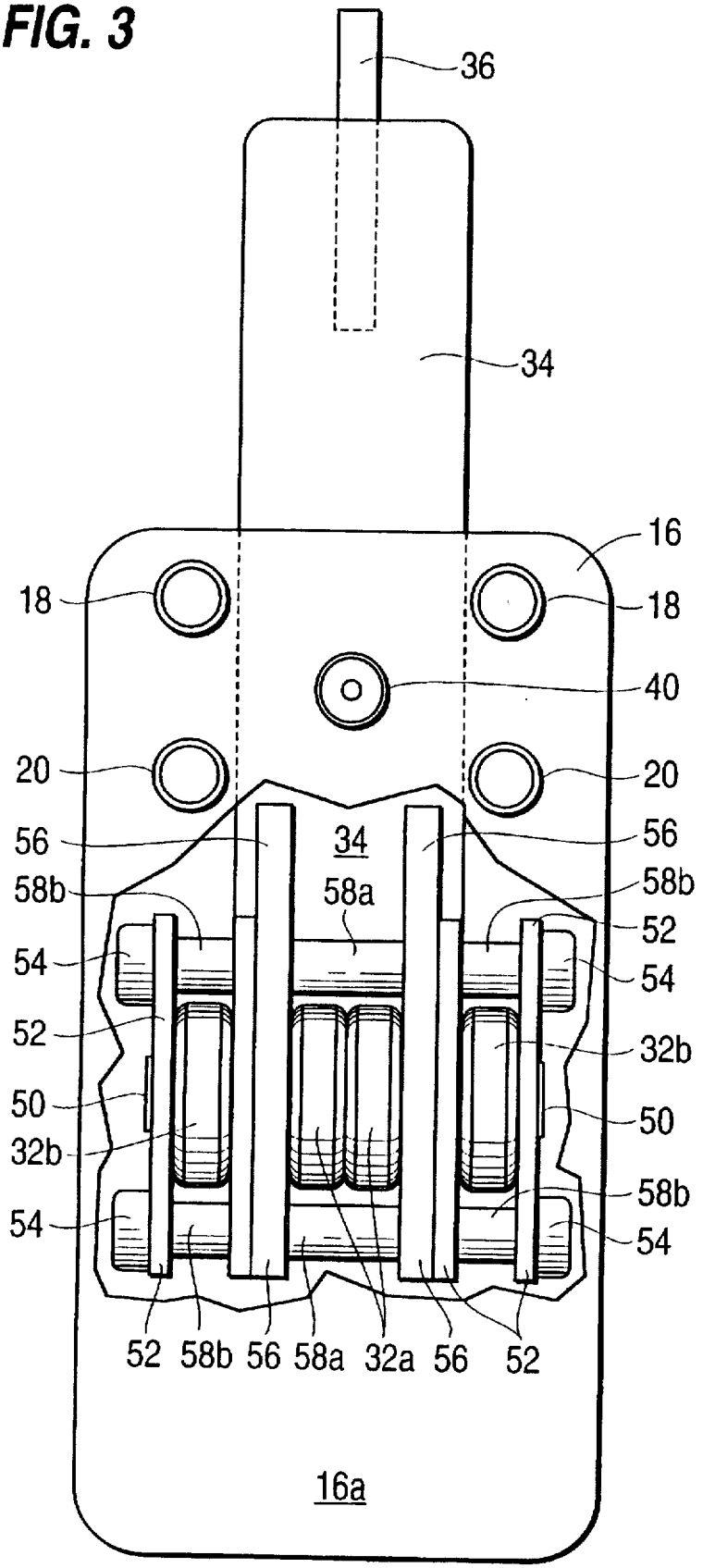
Figure 4:
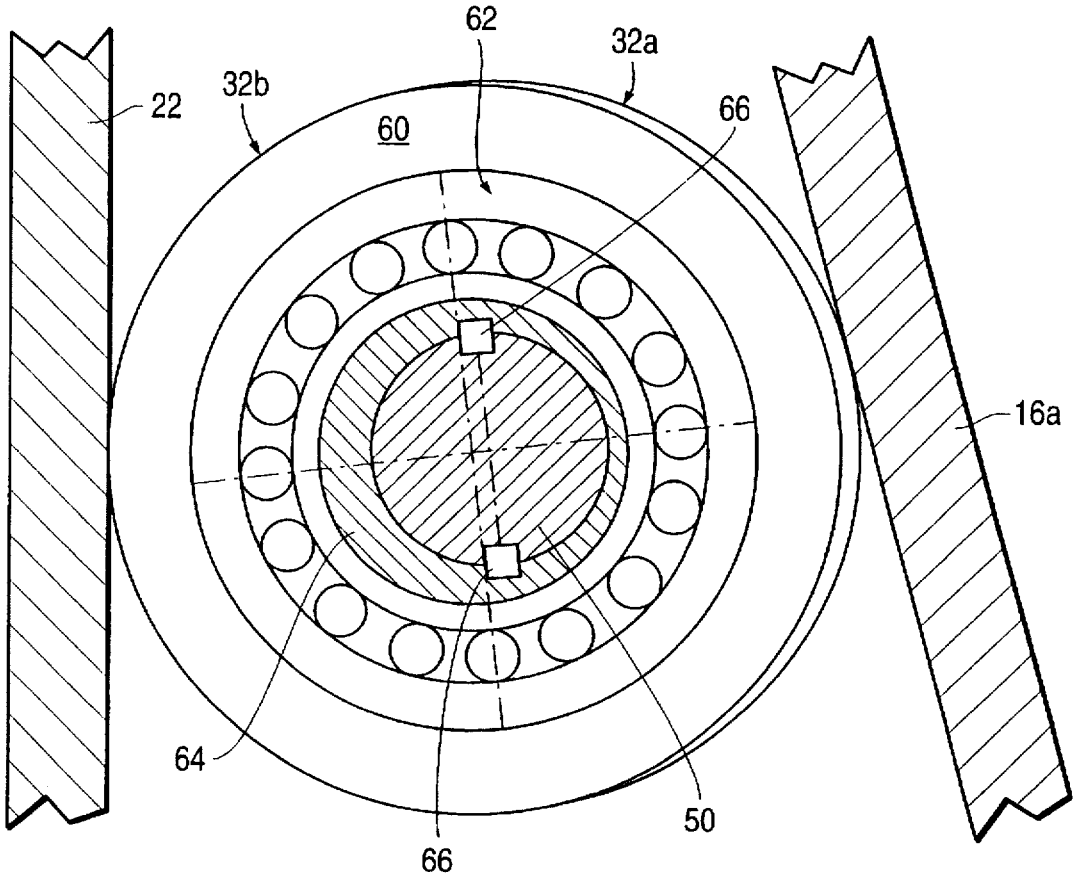
Figure 5:
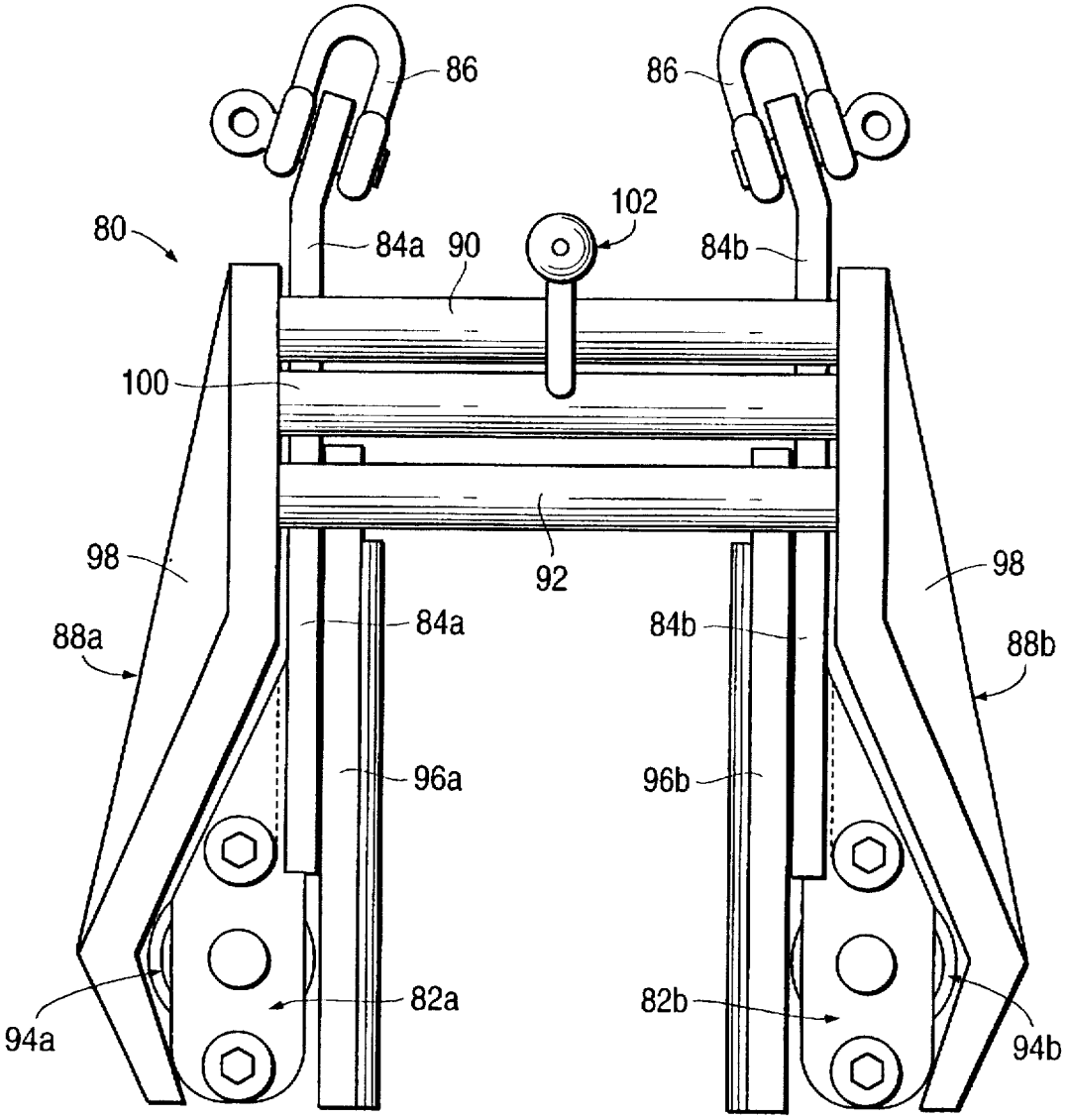
Figure 6:
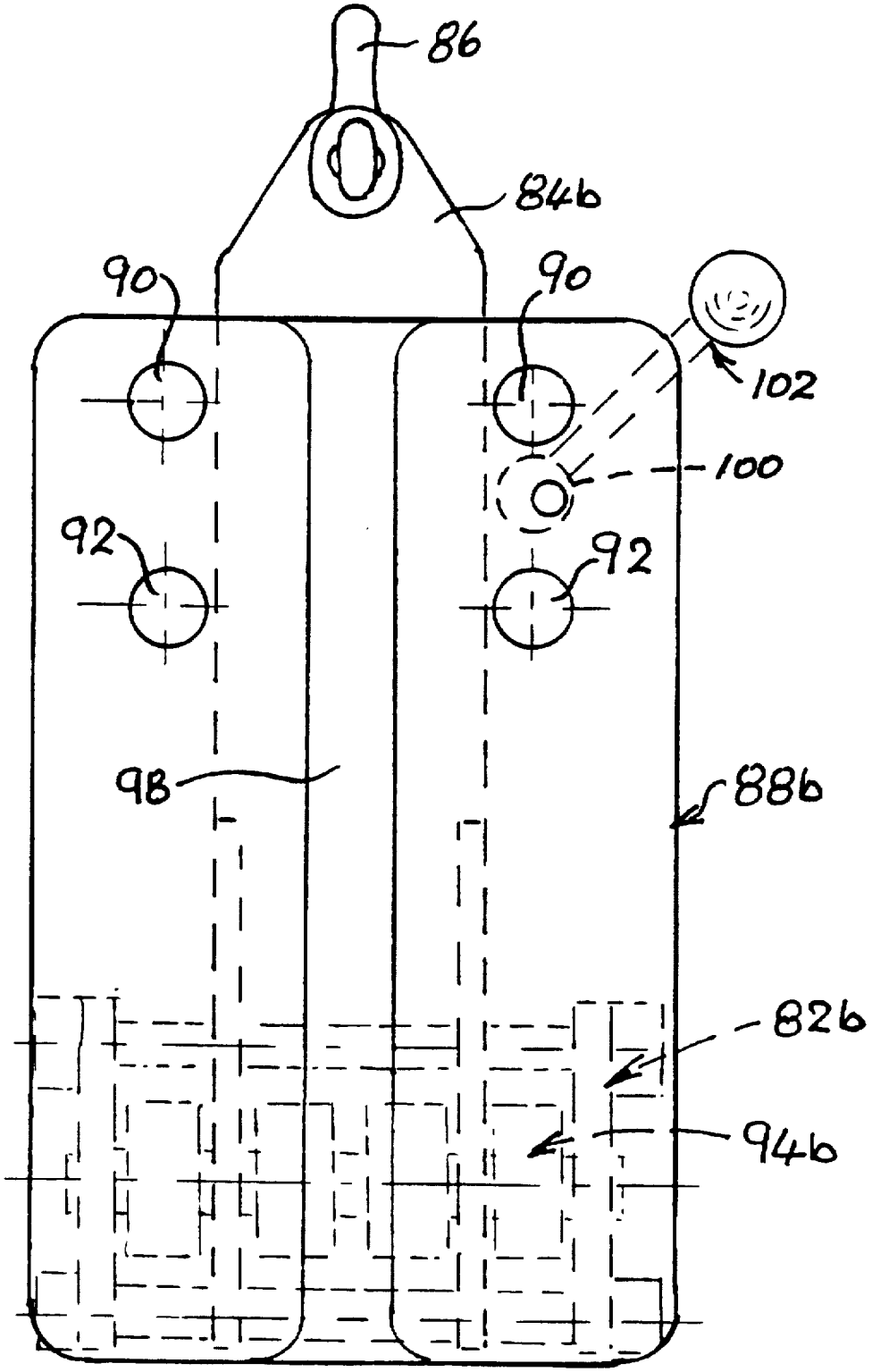
Figure 7:
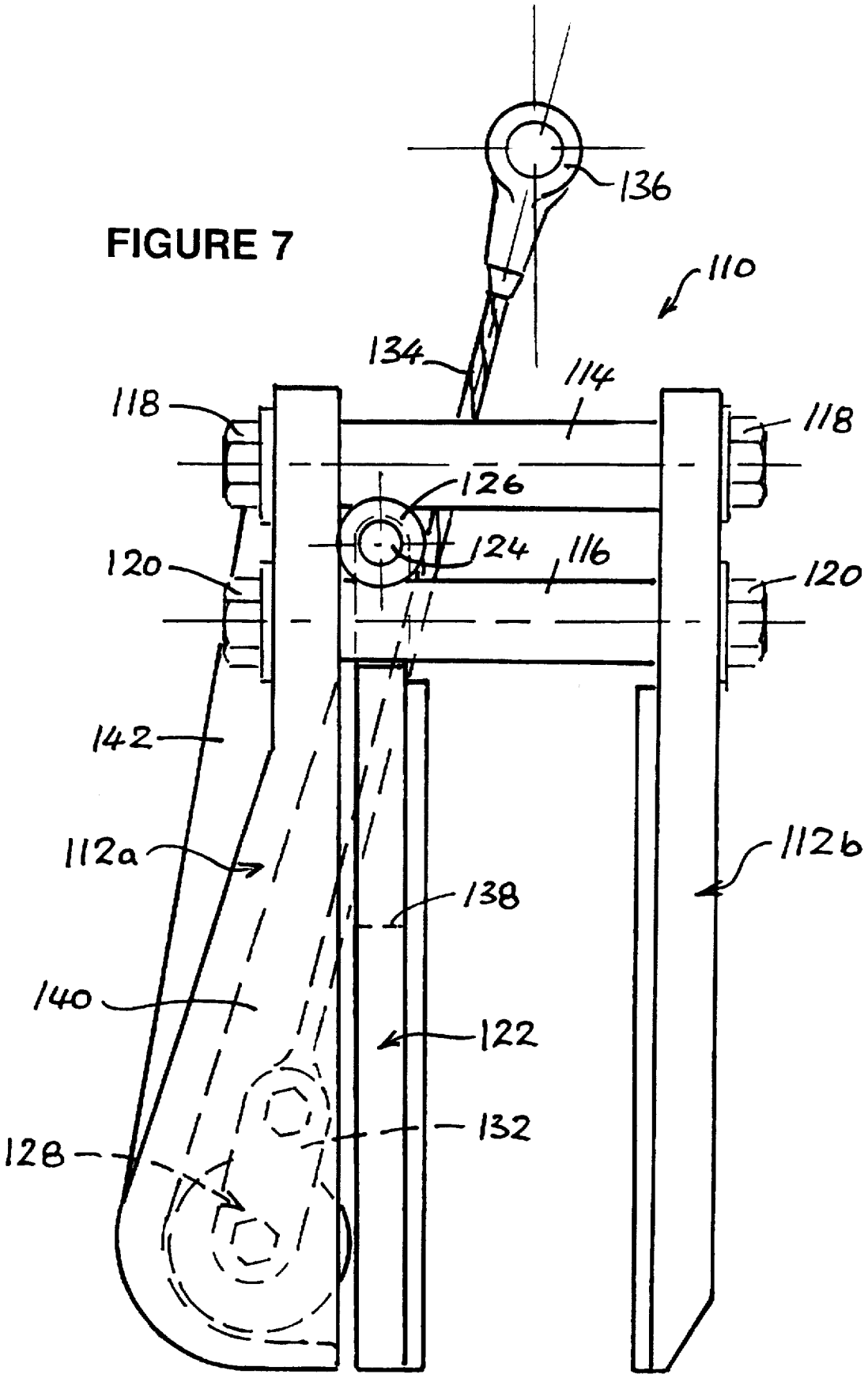

Having broadly portrayed the nature of the present invention, examples of its application will now be described by way of illustration only. In the following description, reference will be made to the accompanying drawings in which:

FIG. 1 is an end elevation of the lifting device which comprises the first example of the invention, the device being shown in the fully open position, FIG. 2 is an end elevation of the lifting device of the first example in the fully closed position, FIG. 3 is a side elevation of the lifting device of the first example with some parts being shown cut-away to reveal the rollers and carriage, FIG. 4 is an enlarged diagrammatic sectional end elevation of the roller assembly of the device of the first example, FIG. 5 is an end elevation of a lifting device which forms the second example of the invention, the device being shown in its fully open position, FIG. 6 is a side elevation of the lifting device of the second example, and FIG. 7 is an end elevation of a lifting device which forms the third example of the invention, the device being shown in its fully open position.

Referring to FIGS. 1, 2 and 3, the lifting device 10 of the first example of the invention basically comprises a rigid frame 12 formed by substantially vertical and opposed left and right side-plates 14 and 16 which have the upper portions rigidly joined by upper and lower pairs of cylindrical cross-members 18 and 20. In this example, left side-plate 14 forms the fixed-jaw of the lifting device, the movable jaw being formed by a plate 22 which is slidably mounted on the lower pair of cross-members 20, plate 22 being biased by springs 24 away from side-plate 14. The inside and opposing faces of jaws (plates) 14 and 22 are lined with a hard rubber material 26 to improve frictional contact with the faces of a slab 28 to be lifted. The lower part 16*a* of side-plate 16 is angled downwardly and away from the opposing side-plate 14 and from movable jaw 22. A carriage 30 is arranged between jaw 22 and the angled portion 16*a* of side-plate 16, the carriage being fitted with a set of rollers 32 and being rigidly attached to the lower end of a strip-like tension member 34, its upper end being provided with an inwardly-facing lug 36 having an eye 38 adapted to take the hook or shackle of a crane (not shown). Tension member 34 is preferably quite stiff, both in the front-to-back and in the side-to-side dimension, and is guided between each pair of cross-members 18 and 20 (in the front-to-back direction) so that the carriage 30 is similarly located.

It will be appreciated that, when device 10 is suspended from lug 36 (and tension member 34), carriage 30 will tend to roll up angled portion 16*a* of side-plate 16 and force plate 22 (which forms the movable jaw) toward side plate 14 (which forms the fixed jaw). However, whether or not plate 22 in fact moves depends upon the strength of spring 24 and the combined weight of frame 12 and plate 22: if a relatively weak spring is use, the jaws will close under the weight of the device; if a relatively strong spring is used, they will remain open. The device can be operated satisfactorily in either case.

Where a weak spring is used, it is convenient to employ a spring-loaded locking-pin 40 fitted to the upper portion of side-plate 16 so that it can engage with a hole 42 in tension member 34, hole 42 being positioned in line with pin 40 when tension member 34 is at its lower-most position (as shown in FIG. 1). Therefore, after device 10 is suspended from a crane but before slab 28 is engaged, the weight of frame 12 is taken off carriage 30 (either by manually raising the frame or by letting it rest on the floor or other surface) so that carriage 30 moves downwards in frame 12 until spring-loaded pin 40 enters hole 42, plate 22 being moved away from plate 14 to the fully-open position as shown in FIG. 1. When the weight of the device is again taken on lug 36, the weight of the frame will be taken by pin 40 so that the frame cannot move down on carriage 30 and close the jaws. After device 10 has been maneuvered into position on slab 28, pin 40 is manually withdrawn to allow frame 12 to move downwards on carriage 30 which, in turn, moves movable jaw (plate 22) against the slab. Then when the device is lifted by the crane, carriage 30 rises between plates 22 and 16 to move plate 22 to forcibly engage slab 28 between it and plate 14 so that the slab cab be lifted. After slab 28 has been moved to its new position and lifting tension removed, carriage 32 and tension member 34 can be returned to the position shown in FIG. 1 and pin 40 re-engaged with hole 42.

Where a relatively strong spring 24 is used, there is no need for locking-pin 40 as the weight of frame 12 alone will not be sufficient to close the jaws against the spring and there is no need for a mechanism to hold the jaws open while the device is suspended from the crane. Instead, device 10 is maneuvered onto slab 28 (as shown in FIG. 1) and then the operator pulls downwardly on the device while tension is taken-up with the crane. This causes jaw-plates 14 and 22 to close and frictionally engage slab 28. At which point, the operator ceases to pull on the device and slab 28 can be lifted as before. As soon as the lifting force is removed, spring 24 will slide plate 22 back to its open position, causing carriage 30 to move downwards on side-plate 16 in so doing.

FIG. 2 shows the device of FIG. 1 in its fully closed position, but it will be appreciated that jaw-plates 14 and 22 can be easily arranged to meet and close tightly if desired; for example, by providing recesses for springs 24 in the plates or appropriately shaping side-plate 14. Where only relatively thick slabs are handled, as in the case of monumental masons, the device can be made so that the jaws do not come together, but care needs to be taken that the minimum thickness of the slab exceeds the gap between the fully-closed jaws by a good safety margin. Where it is desired that such a device be able to lift plates or slabs of less than the safe minimum thickness, it is possible to use adjustable stop-screws (not shown) threaded through plate 14 to reduce the gap between the jaws; or, a spacer plate (not shown) may be attached to the inner face of plate 14 to effect the same result. The preferred method of increasing the capacity of the lifting device is to use a pair of opposed carriages and moving jaws as in the second example of this invention to be described below.

First, the carriage 30 and its set of rollers 32 will be described in more detail with respect to FIGS. 3 and 4. In this example, four rollers 32 are arranged for independent rotation about a common shaft 50 which is mounted by four shackle-plates 52 and a pair of shackle-bolts 54 onto a pair of hanger-plates 56 that are welded to the lower portion of tension member 34. The rollers are thus divided into an inner pair 32*a* which are juxtaposed and an outer pair 32*b* each of which is arranged between a pair of shackle plates 52. To ensure that rollers 32*a* and 32*b* are not jammed when bolts 54 are tightened, pairs of spacer tubes 58*a* and 58*b* (respectively) are arranged between hanger-plates 56 and shackle-plates 52 (respectively). Though all the rollers are preferably of the same diameter, mounted on the common shaft 50 and arranged substantially in-line horizontally (when viewed from the side as in FIG. 3), it will be seen from FIG. 1 that the central pair 32*a* are offset to the right so as to contact frame side-plate 16 (but not moving plate 22) while the outer pair 32*b* are offset to the left so as to contact moving plate 22 (but not frame-plate 16). This ensures that pairs of rollers 32*a* and 32*b* are free to move in opposite directions when carriage 30 is raised or lowered between plates 22 and 16; that is, no roller is forced to scuff one plate or the other.

One suitable way of mounting rollers to achieve desired offset is shown in FIG. 4, the hanger-plates, shackle-plates and shackle-bolts being omitted for the sake of clarity. Outer roller 32*b* (which bears on movable plate 22) is shown in front and in section while the next roller 32*a* (which bears on frame-plate 16) is shown behind. Each roller has a hard-rubber or steel tire 60 fitted around the outer race of a ball or roller bearing 62, the inner race of which is fitted onto an eccentric sleeve 64. Sleeve 64 is keyed by a pair of opposite keys 66 to shaft 50. It will be seen that, by rotating the sleeves 64 of rollers 32*b* (together with shaft 50 and keys 66) so that the thicker part is toward plate 22, rollers 32*b* are moved toward that plate, and, that by disengaging sleeves 64 of rollers 32*a* from shaft 50 and keys 66, rotating them a further 180° (without turning shaft 50) and then re-engaging them on shaft 50 with keys 66, rollers 32*a* are moved toward plate 16 and away from plate 22.

Turing now to FIGS. 5 and 6, the second example of a lifting device formed in accordance with this invention will now be described. It employs a pair of carriages which drive opposed moving jaws toward one another and, therefore, offers twice the jaw-capacity as the device of the first example. The device 80 uses a left and a right carriage assembly 82*a* and 82*b* of the same design as in the first example, each carriage being suspended from a tension member (84*a* or 84*b* respectively) which is fitted with a shackle 86 so that the device can be suspended from a twin wire or chain sling (not shown). In this example, the frame comprises left and right angled side-plates 88*b* and 88*b* rigidly attached by their upper portions to upper and lower pairs of cylindrical cross-members 90 and 92 as described in the first example. The set of rollers 94*a* of left carriage 82*a* rides between left-hand frame side-plate 88*a* and a left-hand movable plate or jaw 96*a*, while the rollers 94*b* of carriage 82*b* ride between frame side-plate 88*b* and right-hand movable plate or jaw 96*b*; the arrangement being such that, when carriages 82*a* and 82*b* are raised in the frame, movable plates 96*a* and 96*b* are driven toward one another by sliding along the lower pair of frame cross-members 92. Given the greater capacity of the lifting device, each side-plate (88*a*, 88*b*) is stiffened by a robust central rib 98.

While moving plates 96*a* and 96*b* may be biased apart using a spring as in the first example, the greater weight of device 80 makes it more convenient to use the arrangement illustrated in FIGS. 5 and 6. Here, a rotatable eccentric clamping bar 100 is arranged between side-plates 88*b* and 88*b* and is provided with a central handle 102 by which it can be rotated to jam tension members 84*a* and 84*b* in any desired position. Thus, after a slab has been lifted into position and the tension on the lifting sling relaxed, the operator manually moves the jaws free of the slab and clamps them in that position by operating handle 102 to rotate bar 100. The device can then be lifted by the sling without re-gripping the slab.

The third example of the invention is shown in FIG. 7 and is a lifting device 110 which has a similar general configuration as that of the first example, having a rigid frame comprising left and right side-plates 112*a* and 112*b* joined by upper and lower pairs of cylindrical cross-members 114 and 116 secured, in this example, by pairs of bolts 118 and 120 (respectively). In this example, the upper end of moving plate or jaw 122 is narrowed so that it can pass upwardly between the front and back cross-members of each pair 114 and 116 to terminate in a shaft 124 that is fitted on its front and rear ends with wheels 126 that serve to support jaw 122 from the lower cross-members 116 so that it can traverse from side to side. As before, the lower part of the side plate or fixed jaw 112*a* is angled outwards to form a wedge-like cavity between it and movable plate or jaw 122 within which a carriage 128 runs, the carriage simply comprising a set of rollers 130 mounted between shackle-plates 132 that are joined to a cable 134 which, in this example, forms the tension member and terminates in a swaged eye 136 by which the device and its slab (not shown) can be lifted. In order to accommodate the cable 134 when the carriage 128 is in its lower position (as shown), and in order to accommodate the upper part shackle plates 132 when carriage 128 is fully raised, the top portion of movable jaw 122 is split, the line of split being indicated by broken line 138. However, cable 134 is captured in the split of the moving jaw 122 by being passed under shaft 124 which bridges this split. Finally, it is to be noted that angled side-plate 112*a* has closed front and back faces 140 so that carriage 128 is substantially enclosed when in its lower position (as shown). As in the second example, angled side-plate 112*a* is stiffened by a central rib 142.

When device 110 of the third example is suspended from a crane and ready for use, the movable jaw 122 can be easily moved to its open (or left-hand) position by manually raising the device (to allow carriage 128 to drop to the bottom of the wedge-shape cavity in side-plate 112*a*) and letting cable 134 pull the movable jaw 122 to the left by contacting shaft 124.

It will be appreciated that the lifting devices of the three examples do not require stacked slabs to be tilted to anything like the degree necessary with conventional scissor lifters. In fact, with the lifters of the first and third examples, the outer slab needs only be tilted to the degree necessary to allow the side-plate which functions as the fixed jaw to be inserted between it and the next slab. This results in a much safer and more economical operation. Moreover, the head-room required to operate the lifters of this invention (particularly those like the first and third examples) is much less than required for a conventional scissors lifter, again making for safer operation in confined places.

While the examples of the lifting devices described with reference to the accompanying drawings have met the objective of the present invention, it will be appreciated by those skilled in the art that many alterations and additions can be made without departing from the scope of the invention as defined by the following claims. For example, it is not essential to employ a carriage with rollers. Instead, low-friction linear bearings can be used between the carriage and the moving jaw and/or the fixed and angled frame side-plate. Such bearings could be of the recirculating-ball type, they could be pads of low-friction material such as Teflon, or they could be metallic surfaces lubricated with a suitable high-pressure lubricant. It will also be appreciated that there is no particular need for the frame of the device to have four cylindrical cross-members, nor is it necessary for the cross-members to be cylindrical (though that is convenient). For example, a pair of vertical plate-like cross-members may be used (one in front and one behind the tension member or members) and the upper part of the movable jaw(s) can ride in slots or grooves provided in these cross-members. It will also be appreciated that the tension member need not be plate-like, as it can be formed as a rod, chain or cable (as in the last example) the lower end of which is attached to the carriage. There is even no need to have a plurality of cross-members as a single cross-member in the form of an inverted channel could be used, provided it had holes to accommodate the tension member and some manner of supporting and guiding the movable jaw(s) was provided. These and many other modifications can be made.

I claim:

1. A device suitable for lifting or handling sheet, panel or slab material, the device comprising:

a frame having:

first and second generally vertical rigid sides arranged in spaced and opposed relation to one another, each of said sides having an upper and a lower portion, a substantially horizontal cross-member rigidly joining said upper portions of said sides together, and the lower portion of the first side shaped so that it diverges outwardly and .downwardly away from the second side, a substantially vertical first movable jaw arranged between the frame sides and depending from and slidably mounted on said cross-member for substantially horizontal movement between said sides, a first carriage arranged between the lower portion of the first side and said movable jaw for vertical movement with respect to the frame so that, as said carriage is raised in the frame, it will ride on the divergent lower portion of the first side and force the movable jaw horizontally toward the second frame side, and a first tension member connected to said carriage and extending upwards from the frame, whereby both the carriage and the lifting device as a whole may be raised by the application of an upward force to said tension member causing said movable jaw to be moved toward said second frame side.

2. A device according to claim 1 wherein:

the lower portion of the second side of the frame is oriented so that it diverges outwardly and downwardly away from the first side of the frame, a substantially vertical second movable jaw is arranged between the frame sides and depends from and is slidably mounted on said cross-member for substantially horizontal movement between said sides, said second movable jaw being juxtaposed to the first movable jaw, a second carriage is arranged between the lower portion of the second frame side and said second movable jaw for vertical movement with respect to the frame so that, as said second carriage is raised in the frame, it will ride on the divergent lower portion of the second frame side and force the second movable jaw horizontally toward the first movable jaw and toward the first frame side, a second tension member is connected to said second carriage and extends upwards from the frame, whereby both the second carriage and the lifting device as a whole may be raised by the application of an upward force to said second tension member, and the arrangement is such that lifting of the device by both the first and the second tension members raises the first and second carriages within the frame and urges the first and second movable jaws towards one another to close upon a slab or panel therebetween.

3. A device according to claim 1 wherein:

a first roller or set of rollers is mounted in each carriage and arranged to bear against the adjacent frame side, but not against the adjacent movable jaw, and a second roller or set of rollers is mounted in each carriage and arranged to bear against the adjacent movable jaw but not against the adjacent frame side, whereby raising of said carriage with respect to the frame causes said first and said second rollers or sets of rollers to rotate in opposite directions.

4. A device according to claim 3 wherein:

said first and said second roller, or said first and second sets of rollers, are mounted for rotation about a common shaft, and an eccentric cylindrical sleeve is arranged between each roller and the shaft so that each roller rotates about an axis which is offset from that of the shaft.

5. A device according to claim 1 having spring bias means adapted to bias said movable jaw against its adjacent carriage.

6. A device according to claim 1having locking means operable to lock or hold each moving jaw relative to the frame.

7. A device according to claim 1 wherein said tension member is stiff and is guided by said cross-member for horizontal movement in the direction of movement of the attached movable jaw and for vertical movement relative to said movable jaw but against movement in the direction orthogonal to that of the movable jaw, whereby the carriage attached to said tension member is guided in the same manner.

8. A device according to claim 1, wherein:

said tension member is a flexible cable or rod, a guide slot is formed in the upper portion of the movable jaw associated with said tension member, and said tension member passes through said slot so that it is guided thereby for substantially vertical movement but against lateral movement relative to said movable jaw.

9. A device according to claim 8 wherein said slot is closed at its upper end so that the respective movable jaw may be moved with respect to the frame when no slab or panel is gripped by the device by manipulation of the cable or rod passing through said slot.

10. A lifting device according to claim 1 wherein each side of the frame which has a divergent lower portion is provided with front and rear flange members which reinforce said side against outward bending and which partially enclose said carriage.

11. A lifting device according to claim 1 wherein each side of the frame that has a lower portion which slopes downwardly and outwardly is provided with a bottom edge portion that extends inwardly, whereby the carriage adjacent to said side is prevented from dropping below the frame.

* * * * *